United States Patent [19]

Tholkes

[11] Patent Number: 5,054,852

[45] Date of Patent: Oct. 8, 1991

[54] UTILITY STATION WITH CONTROLLED SEATING

[76] Inventor: Alan L. Tholkes, 913 S. Washington, Redwood Falls, Minn. 56283

[21] Appl. No.: 400,338

[22] Filed: Aug. 30, 1989

[51] Int. Cl.[5] ..... A47B 83/02; A61G 7/00

[52] U.S. Cl. ..... 297/172; 297/423; 297/DIG. 10

[58] Field of Search ..... 297/170, 172, 174, 423, 297/DIG. 10

[56] References Cited

U.S. PATENT DOCUMENTS

| | | | |
|---|---|---|---|
| 1,731,375 | 10/1929 | Engers | 297/172 |
| 1,858,103 | 5/1952 | Menon | 297/172 X |
| 4,249,774 | 2/1981 | Andreasson | 297/DIG. 10 X |
| 4,802,542 | 2/1989 | Houston et al. | 297/423 X |
| 4,809,804 | 3/1989 | Houston et al. | 297/423 X |

*Primary Examiner*—Peter R. Brown

*Attorney, Agent, or Firm*—D. L. Tschida

[57] ABSTRACT

A self-directed seating support and posture control assembly operable between fully seated and erect posture positions. A hand operated, hydraulic lift mechanism pivotally supports a cushioned seat and folding linkage from a base framework. A forward positioned upright utility platform includes a heighth and tilt adjustable tabletop. Depth controllable, cushioned knee/-calf and mid-section supports extend from the platform uprights. An accessory, upper body exerciser detachably mounts to the chair back at pivotally mounted arm rests.

10 Claims, 11 Drawing Sheets

UTILITY STATION WITH CONTROLLED SEATING

BACKGROUND OF INVENTION

The present invention relates to a posture control aid for the handicapped and, in particular, to a self-directed, manually operated assembly for stabilizing a user's legs relative to a position adjustable seating assembly and upright utility platform.

Wheelchair users and other individuals having limited lower trunk or leg control functions, overtime typically experience a progressive atrophying of the leg and calf muscles, due to the lack of use. Without the aid of an attendant, it is difficult for such individuals to achieve a measure of physical therapy to maintain the muscle tone of the legs. A supported transfer of body weight to the lower limbs is, however, particularly desirable in that such activity induces muscle activity with consequent blood flow to the exercised limbs.

Accordindly, a need exists for an assembly whereby a user may, without outside intervention, position himself/herself to obtain a manipulation of the lower trunk between fully seated and erect postures.

Although applicant is unfamiliar with any assembly providing for the combinational advantages of the present invention, applicant is aware of various powered lift assemblies which are disclosed in U.S. Pat. No.'s 4,569,094 and 4,725,056. Such assemblies either incorporate sling seats having no back support, as do a number of other commercial units of which Applicant is aware, or are of relatively complex constructions to rigidly brace the occupant fore and aft relative to the assembly.

Other powered wheelchairs of which Applicant is aware which include seat assemblies that provide for seated and upright postures are disclosed in U.S. Pat. No.'s 4,545,616; 4,456,086 and 4,054,319. The lift mechanisms for such assemblies are believed distinguishable in that they are either coupled to the seat back to raise the back and thereby induce a desired folding of a multi-hinged chair or include a motorized jacking screw coupled to a front edge of the seat platform to raise the edge and induce a desired folding action.

Applicant is also aware of wheelchairs including seat mounted, hydraulic assist cylinders, which facilitate a standing motion for users who have partial use of their lower limbs and which are disclosed in U.S. Pat. No.'s 4,632,455 and 4,569,556. U.S. Pat. No. 3,023,048 discloses another seat assisted device, but wherein the backrest does not simultaneously fold with the seat assembly.

Otherwise, none of the assemblies of which Applicant is aware provide for an assembly including a hand operated hydraulically actuated lifting mechanism or one including an integral upright utility platform from which knee/calf and mid-section supports extend to brace the user therebetween. Moreover none of such devices provide for a lift framework which includes a single follower arm for inducing a simultaneous folding of the backrest.

SUMMARY OF INVENTION

It is accordingly a primary object of the present invention to provide a wheelchair accessible exerciser/utility station permitting the user to independently access the station and obtain self-directed manipulation and weight transfer to the lower limbs.

It is a further object of the invention to provide a cushioned platform for supporting the user in fully seated and erect postures.

It is another object of the invention to provide a tabletop platform adjustably positionable relative to the user.

It is another object of the invention to provide a leg restraint assembly which may be manipulated by the seated user to stabilize the lower limbs and permit weight transfer thereto.

It is another object to provide an adjustable midsection support assembly for the user, when upright.

It is another object of the invention to provide a hydraulically rotatable seating platform and follower support linkage for simultaneously directing the backrest to maintain continuous contact with the user.

It is a still further object of the invention to provide an upper-body accessory exerciser mountable to the seat support platform.

It is a yet further object of the invention to provide pivotally mounted armrests.

Various of the foregoing objects are particularly achieved in a presently preferred embodiment which comprises a metal formed framework having a modified H-shaped base support, to which a seat is pivotally mounted and to a forward end of which an adjustable upright tabletop platform is mounted. Coupled to the base adjacent a horizontal support are upright columns which support pivotally connected linkages of a cushioned seat and backrest. The seat support particularly includes a contoured cushion which supports the buttocks, when seated, and the lower-back, when standing. A hand actuated, telescoping pump arm directs a piston of a hydraulic lift mechanism relative to a pivot arm secured to the front of a seat support platform. A second release arm releases the pump pressure.

Projecting from the sides of the backrest platform are pivotally positioned armrests. An accessory, upper body, weight exerciser assembly is mountable to the backrest adjacent the ends of the armrests.

A cushioned knee and calf support projects in length adjustable relation to the tabletop upright supports. In one embodiment, oppositely positioned pairs of pivot and latch pins support notched extension members in length adjustable relation to the user. In another embodiment, the support is rotationally mounted in a spring biased fashion along a pivot axis to rotate in a plane parallel to the knees/calves.

A cushioned mid-section support also adjustably extends from the upright supports to contact the upright user.

Still other objects, advantages and distinctions of the invention, as well as its particular construction, will become more apparent upon directing attention to the following detailed description with respect to the appended drawings. Before referring thereto, it is to be appreciated that the following description is illustrative only of the presently preferred embodiment and variously considered modifications thereto. The invention should therefore not be strictly limited to the disclosure herein nor should the disclosure be interpreted in limitation of the spirit and scope of the invention as claimed hereinafter.

DESCRIPTION OF PREFERRED EMBODIMENT

Figure 1:
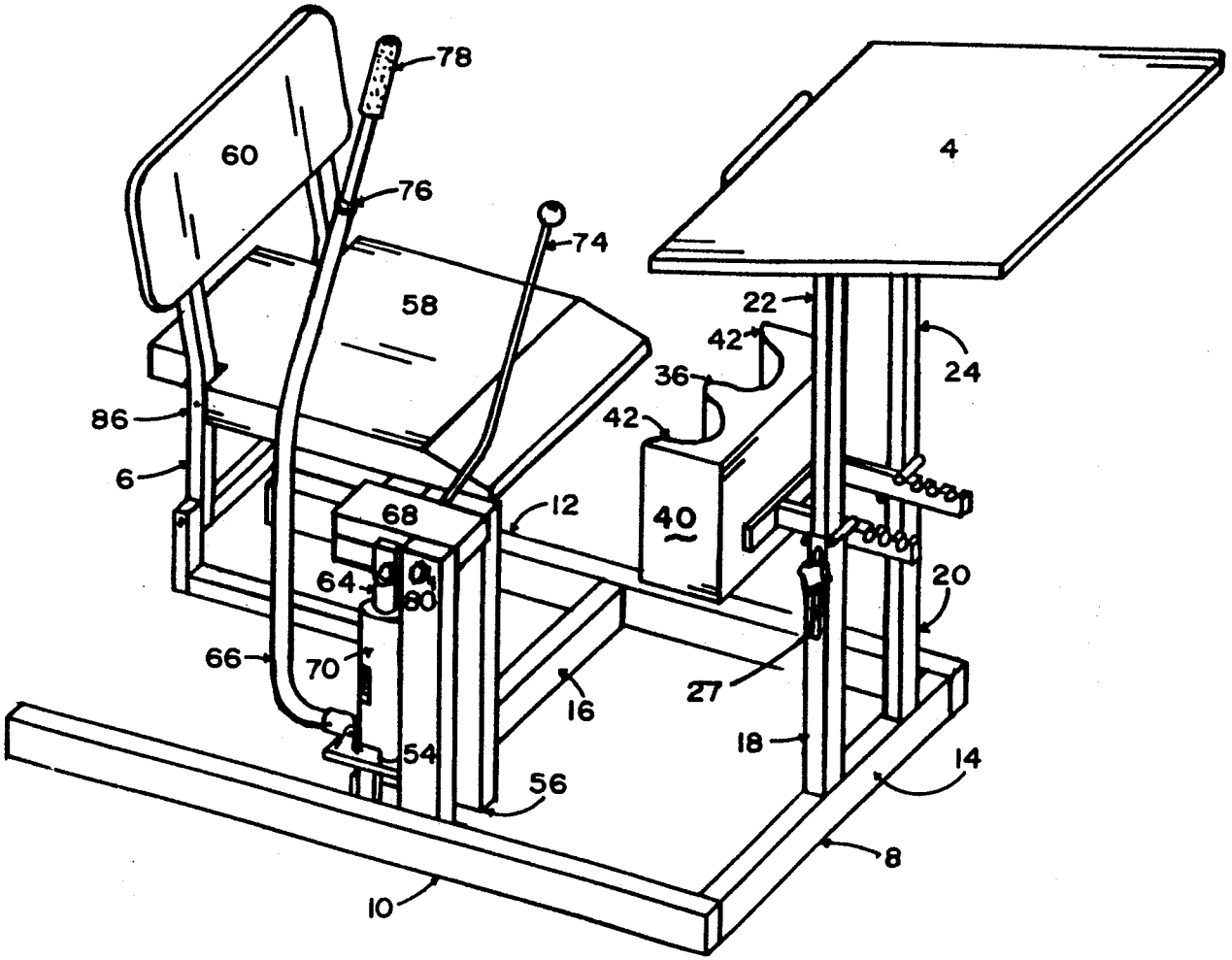
FIG. 1 shows an isometric view of the present utility-/exerciser station from its hydraulic side.
Figure 2:
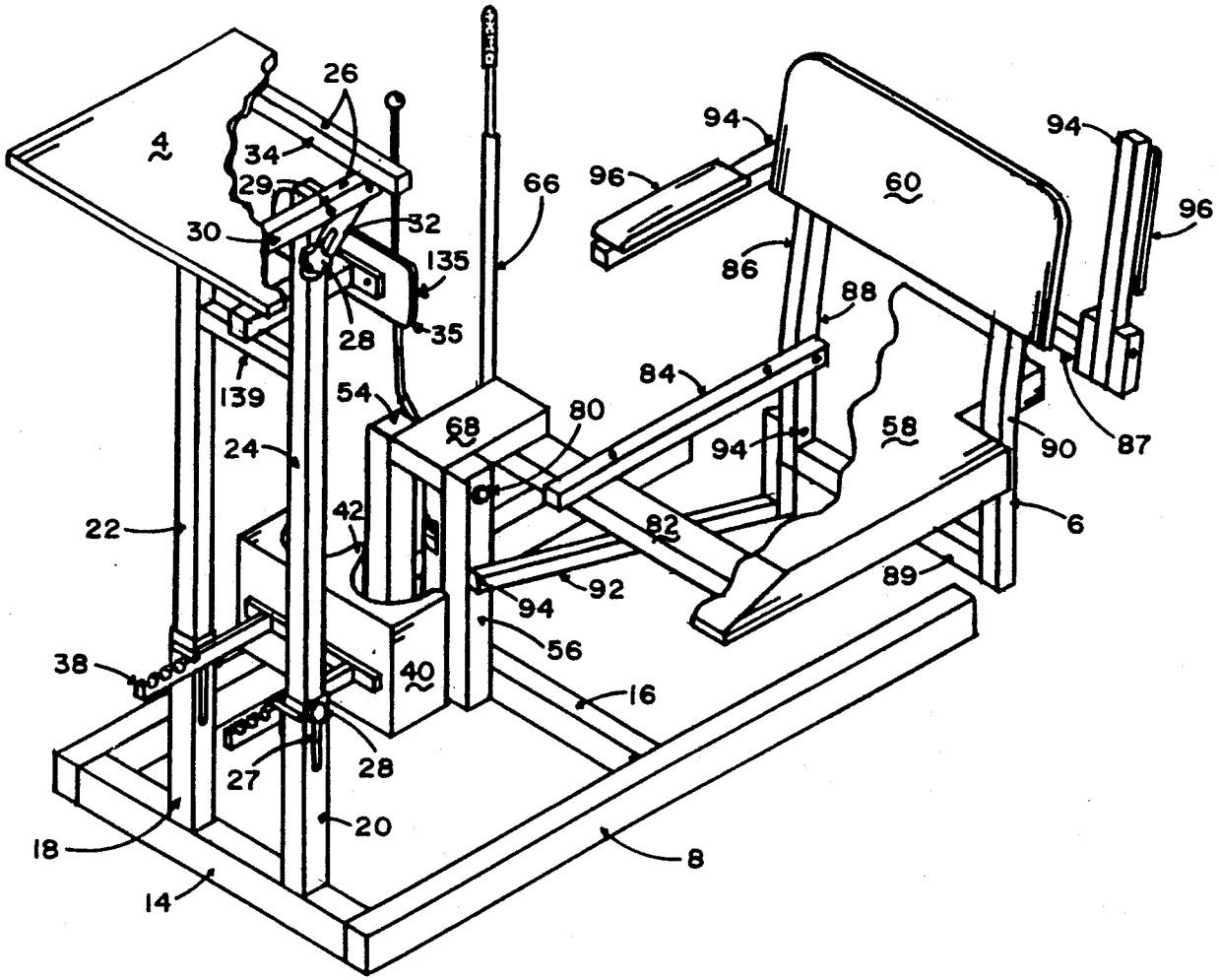
FIG. 2 shows an isometric view in partial cut away of the present utility/exerciser from its user access side.

Referring to FIGS. 1 and 2, isometric views are shown of the present utility/exerciser assembly 2 from alternative perspectives; that is, when alternatively viewed from the hydraulic actuator and the user access sides of the assembly. FIG. 2 additionally shows in partial cutaway details of the tabletop support platform 4 and a seat framework 6. Also more apparent from FIG. 2 is the mid-section support assembly 35, which will be described in detail relative to FIG. 11.

Generally, however, the utility/exerciser 2 comprises a modified H-shaped base support framework 8 having a pair of left and right longitudinal frame members 10 and 12 which are secured to one another via a pair of fore and aft positioned cross members 14 and 16. The frame members as well as various other members described below, are comprised of rectangular tube stock of a nominal 1¼ inch bye 2 inch dimension. Alternatively other dimensioned stock or round tube stock or flat stock might be substituted, as desired.

Vertically extending from the forward cross member 14 are a pair of height adjustable columns which include upright members 18 and 20 and slidably respectively mounted within which are a second pair of upright members 22 and 24 that extend to a tabletop support framework 25. The relative height of the second pair of upright members 22 and 24 may be fixed relative to the lower pair 18 and 20 via longitudinal slots 27 formed in the vertical sides of each lower upright member 18 and 20. A threaded bolt (not shown) and associated hand wheel nut member 28 provide a clamping action relative to the uprights and permit the selective height adjustment of the pairs of uprights 18, 22 and 20, 24 relative to one another, upon tightening the hand wheel members 28. It is to be appreciated that various other alternative clamping assemblies might be employed which permit greater or lesser amounts of relative height adjustment.

Pivotally secured to the top of each upright 22, 24 at a pair of pivot pins 29 is the tabletop support framework 25. The framework 25 is comprised of a pair of longitudinal members 30, only one of which is shown, which are pivotally mounted at the pivot pins 29, midway along their lengths to the uppermost end of each vertical upright 22 and 24. A slotted scissors arm 32, only one of which is shown, is pivotally secured to an aft end of each longitudinal member 30, while a slotted fore-end is adjustably secured to a lower portion of each upright via second threaded, hand wheel adjusters 28. A lateral frame member 34 is secured between each of the longitudinal members.

The tabletop 4 is fastened to the framework 26 with suitable fasteners. Depending upon the application, the size of the tabletop 4 and working surface may be appropriately sized, formed and covered to accommodate the desired function. Where exercise is the principal goal, a smaller tabletop may be preferred or possibly one which is shaped to conform to the exercise activity. Otherwise a relatively large work surface might be substituted.

Positioned beneath the tabletop 4 and secured in length adjustable relation at 90 degrees to the uprights 18, 22 and 20, 24 at their coupling is a mid-section support assembly 35 and knee/calf support cushion assembly 36, both of which will be described in greater detail with respect to FIGS. 11 and 3. Generally, however, the assembly 35 provides for a support cushion 135 which is length adjustably secured to a cross frame member 139. Upon establishing the length of the extension portion, the cushion 135 contacts the user in the area of the user's stomach to the chest to permit leaning. The rotated seat framework 6, meantime and as described below supports the back of the user.

The knee/calf assembly 36, in turn, includes a welded bracket 38 which is length adjustably secured to the uprights. A support cushioned 40 extends laterally across the bracket 38 to provide a padded support to the knees/calves of the user, either seated or in a fullY erect position. Vertical recessed channels 42 formed in the face of the cushion 40, particularly, mount about the calves of the user to provide a forward resting surface and leg restraint. Although not shown, it is to be appreciated that padded straps might be used in conjunction with the cushion 40 to secure the user's legs thereto. Similarly a waist strap might be used with the seat framework.

Figure 3:
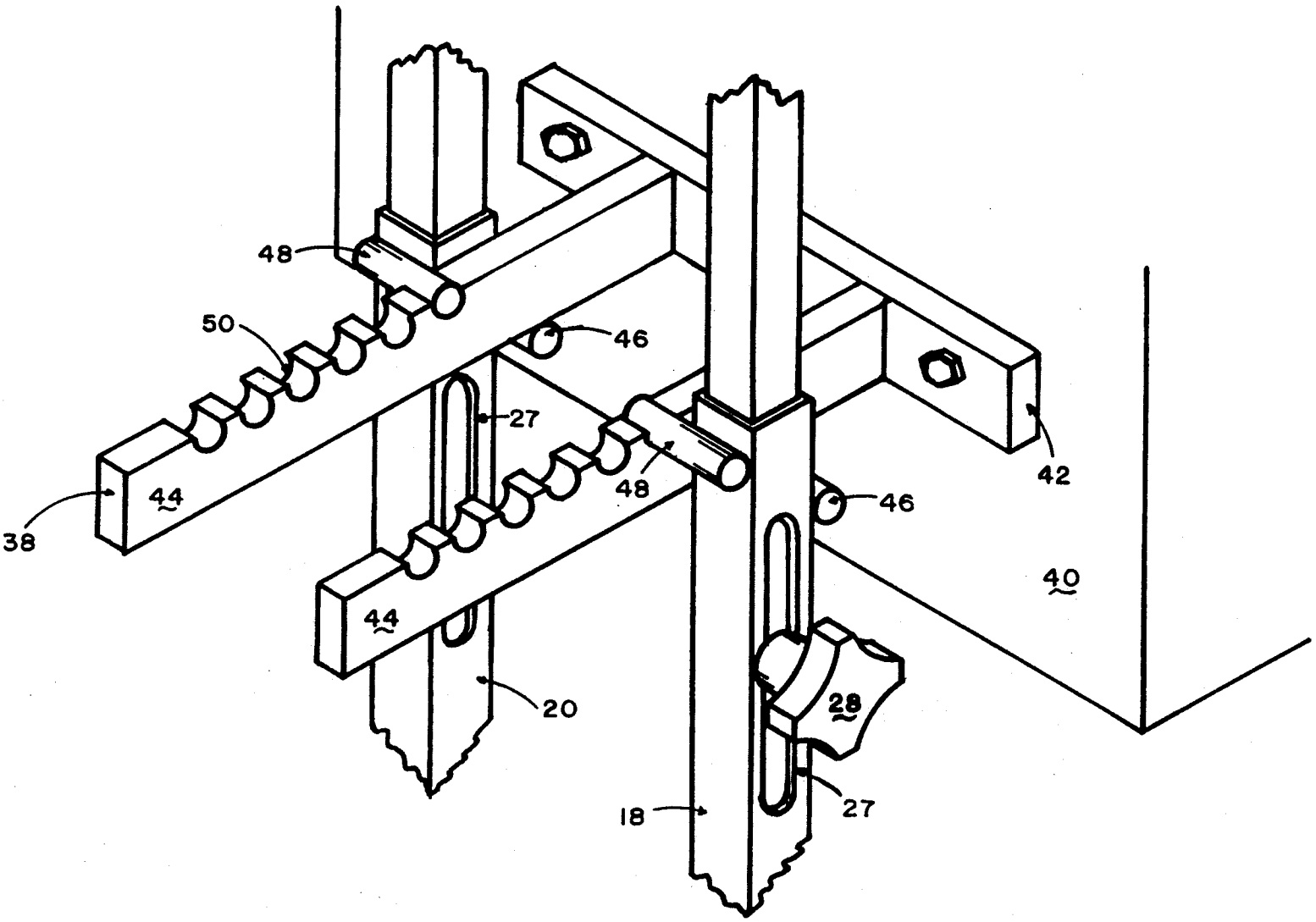
FIG. 3 shows a detailed isometric view of the length adjustment and matching mechanism of the knee/calf support assembly.
Figure 7:
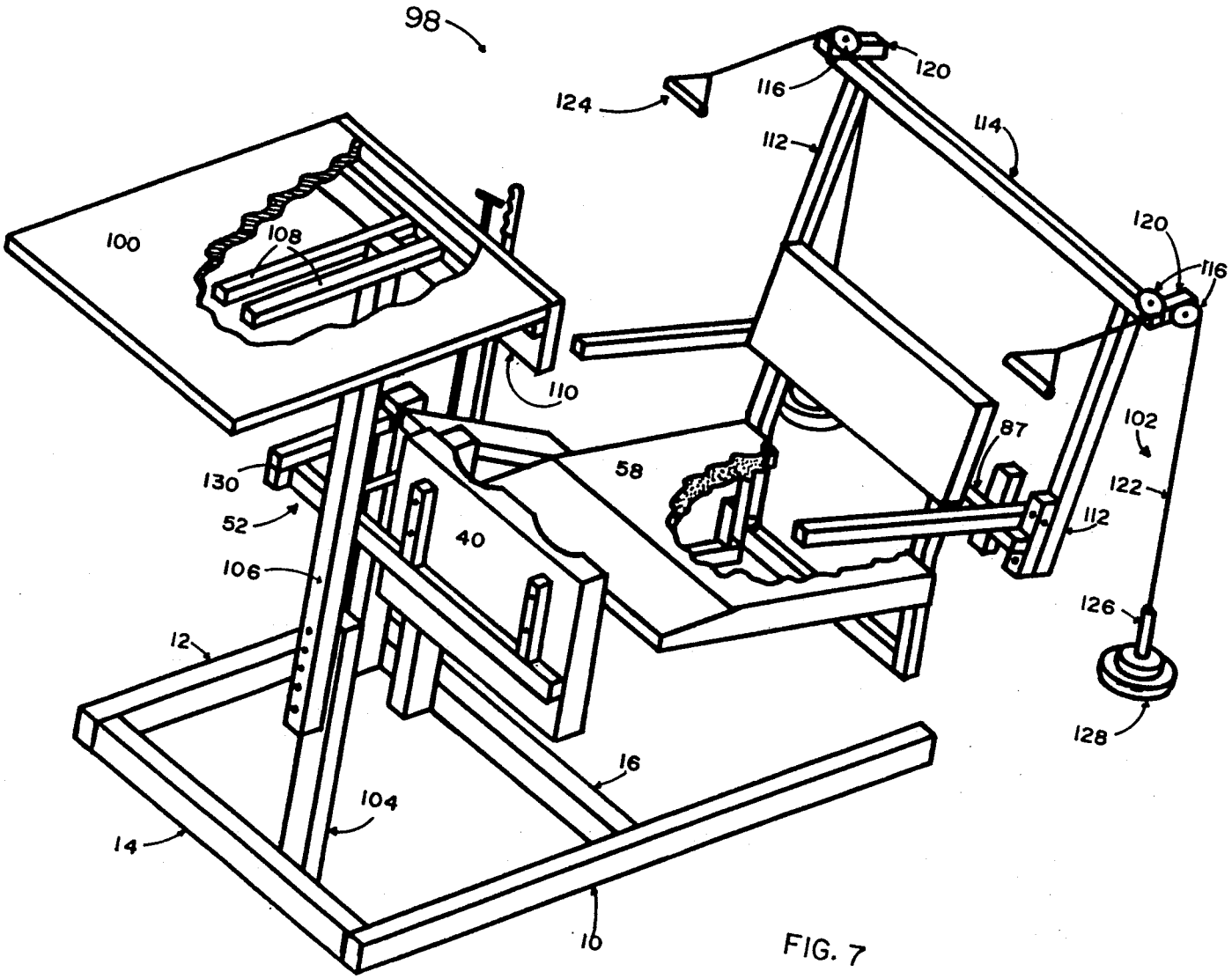
FIG. 7 shows an isometric view of an alternative embodiment of the invention including a pivotally mounted knee support and upper body exerciser assembly.

Otherwise and with additional attention to FIG. 3, extending rearward from the cushion 40 is a length adjustable bracket 38 which includes a lateral cushion mounting bracket 42 and from which extend right and left, notched extension arms 44. Each extension arm 44 is supported on a lower rail surface via pin members 46 which extend from the right and left lower uprights 18, 20. Upper pin members 48 which extend from each upright, in turn and due to the weight of the cushion 40, latchably, selectively engage a desired one of the notches 50 provided in each extension arm 44. Thus, upon rotating the cushion 40 upward, each extension arm 44 is released from its latched pin members 46, 48 and the cushion 40 may be either extended or retracted, as desired. FIG. 7, which will be discussed below, discloses an alternative spring biased, knee support assembly 52.

Figure 11:
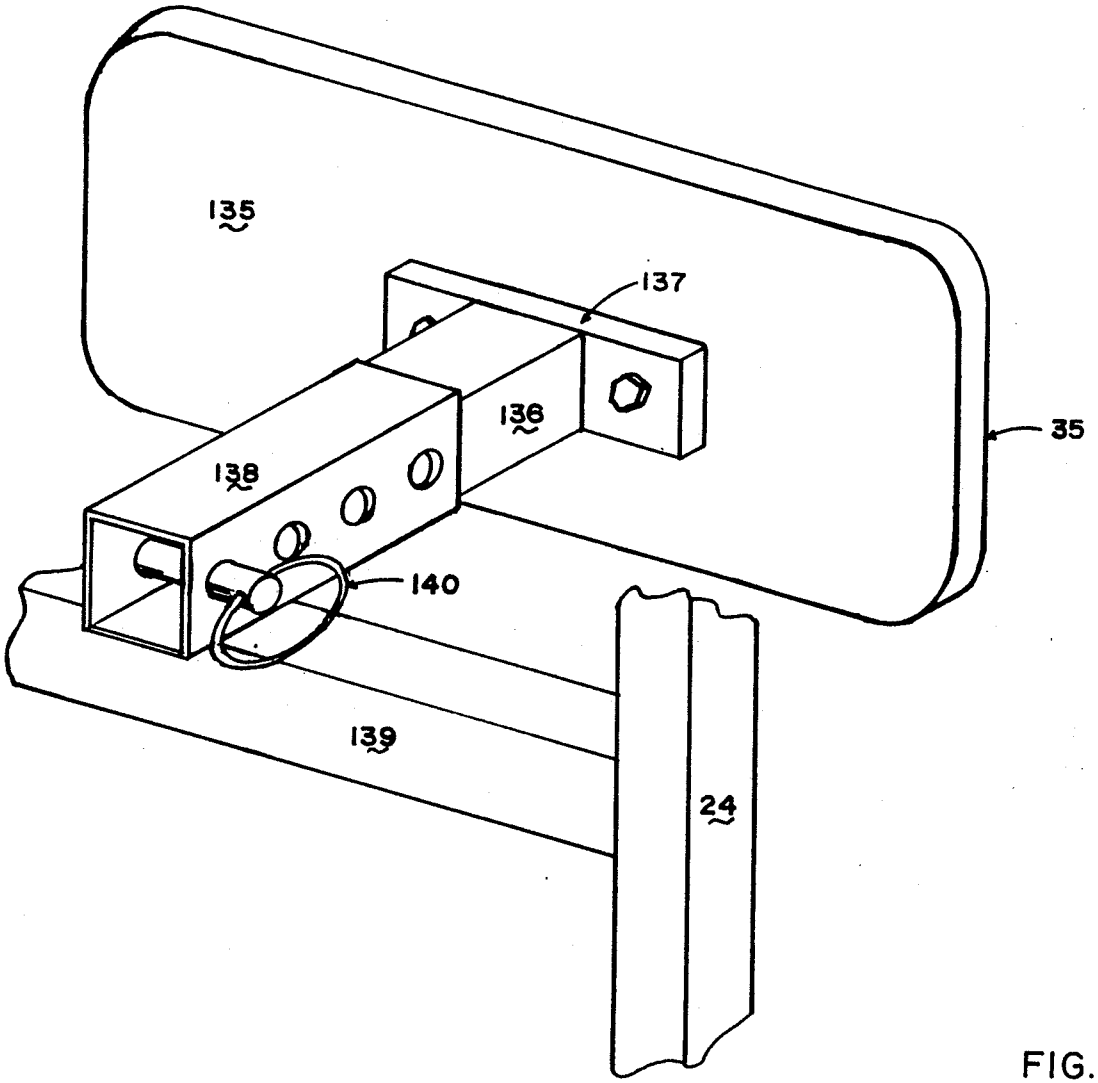
FIG. 11 shows a detailed isometric view of the mid-section support assembly.

FIG. 11, otherwise depicts the details of the midsection support assembly 35. In particular, it comprises a pinned side extension arrangement having a slide member 136 which is secured at one end to a bracket 137 and the cushion 135 via suitable fasteners (not shown). Its opposite end is slide mounted in a tubular motion 138 welded to the cross member 139. A linch pin 140 mounts through mating holes in the members 136 and 138.

Figure 4:
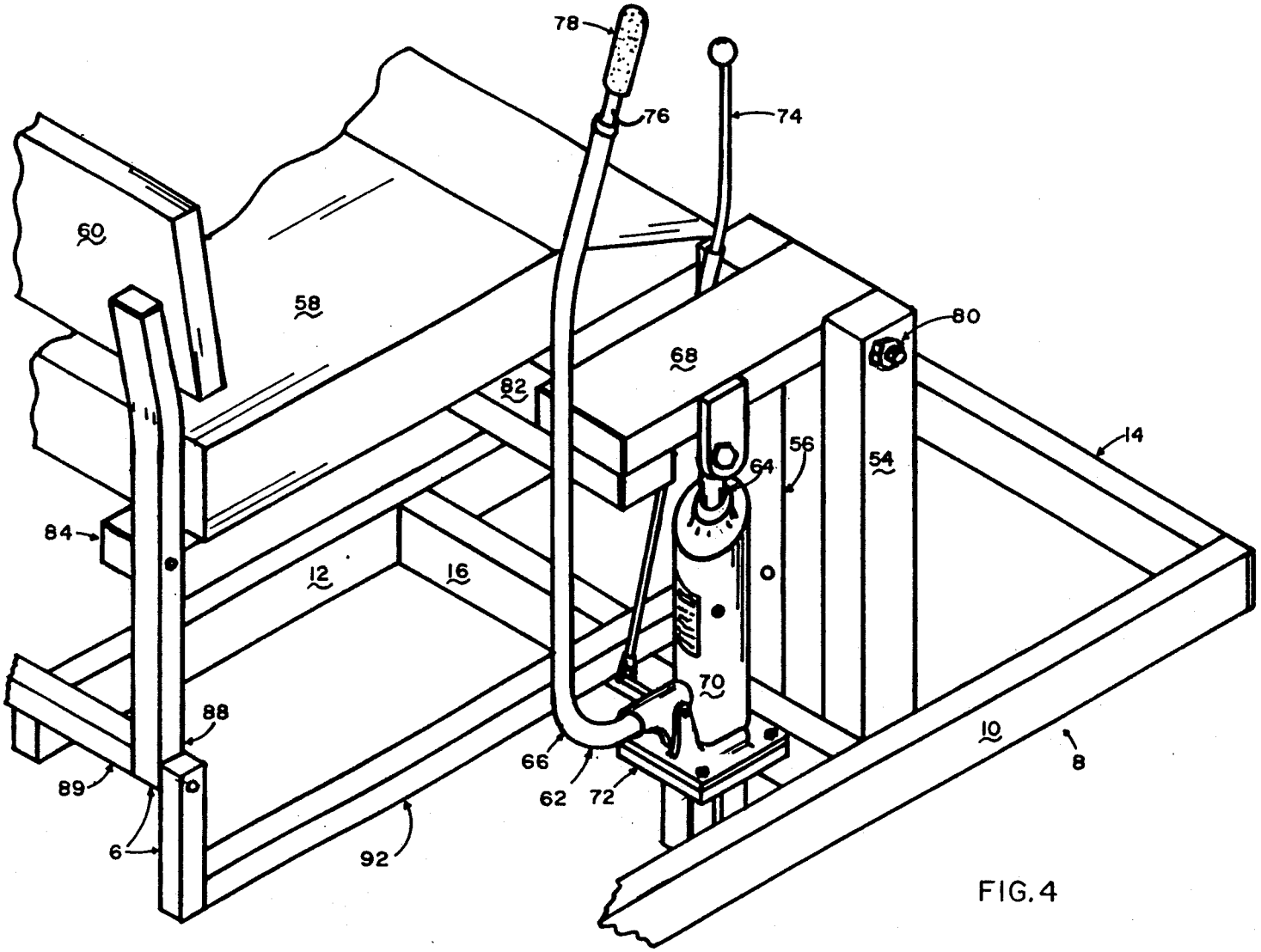
FIG. 4 shows a detailed isometric view of the hydraulic actuator relative to the seat and back rest support linkages.

With further reference to FIG. 4, mounted midway along the base support framework 8 to the cross support 16 are a second pair of vertical upright members 54, 56 and to which padded seat and backrest support cushions 58 and 60 are pivotally mounted in relation to a hydraulic pump assembly 62. A piston 64 extending from the pump assembly 62 is manually controlled via a hand pump lever 66 which, as it is pumped, induces upward pressure on a pivot arm 68 secured between the uprights 54, 56 to the seat framework 6. The pump 70, otherwise, is rigidly secured at a support platform 72 mounted adjacent the cross member 16.

A hand release lever 74 also extends from a release linkage to the lower end of the pump 70 in accessible relation to the user, whether seated or standing, to permit the user to release the piston 64 and controllably lower the seat platform 58, once raised. In passing, it is also to be noted that the pump lever arm 66 is of a slide telescoping construction. That is, an upper hand grasp portion 78 is slidably mounted in a collar 76 and the arm 66 to permit an in-and-out movement as the arm 66 is pumped relative to the user.

With attention re-directed to FIG. 2, the particular details of the seat framework 6 become more apparent. As mentioned the framework 6 is secured to the pivot or link arm 68 which, in turn, is pivotally secured at its forward end to the uprights 54, 56 via a captured pivot pin 80. A lateral cross member 82 is weldably secured to an opposite end of the arm 68 and extends across the rigid base of the upholstered seat cushion 58. Mounted between the two, however, are a pair of longitudinal seat support members 84 (only one of which is shown).

Each seat support member 84 is pivotally secured to an upright rectangular portion of the seat framework 6 or a backrest framework 86 at a pair of vertical members 88 and 90. The vertical members 88, 90 are coupled to one another via upper and lower cross members 87, 89. The backrest framework 86, in turn, is secured between the right upright member 56 and the vertical member 88 via an L-shaped follower arm 92 and pivot pins 94.

Otherwise, extending forward from the upper lateral cross member 87 are a pair of arm rest support arms 94 and their associated cushioned arm rests 96. For the embodiment of FIG. 2, the pump-side arm rest 94 is rigidly mounted. The opposite arm rest 94 is otherwise pivotally mounted such that it may be raised and lowered during user access to the seat cushion 58.

Figure 5:
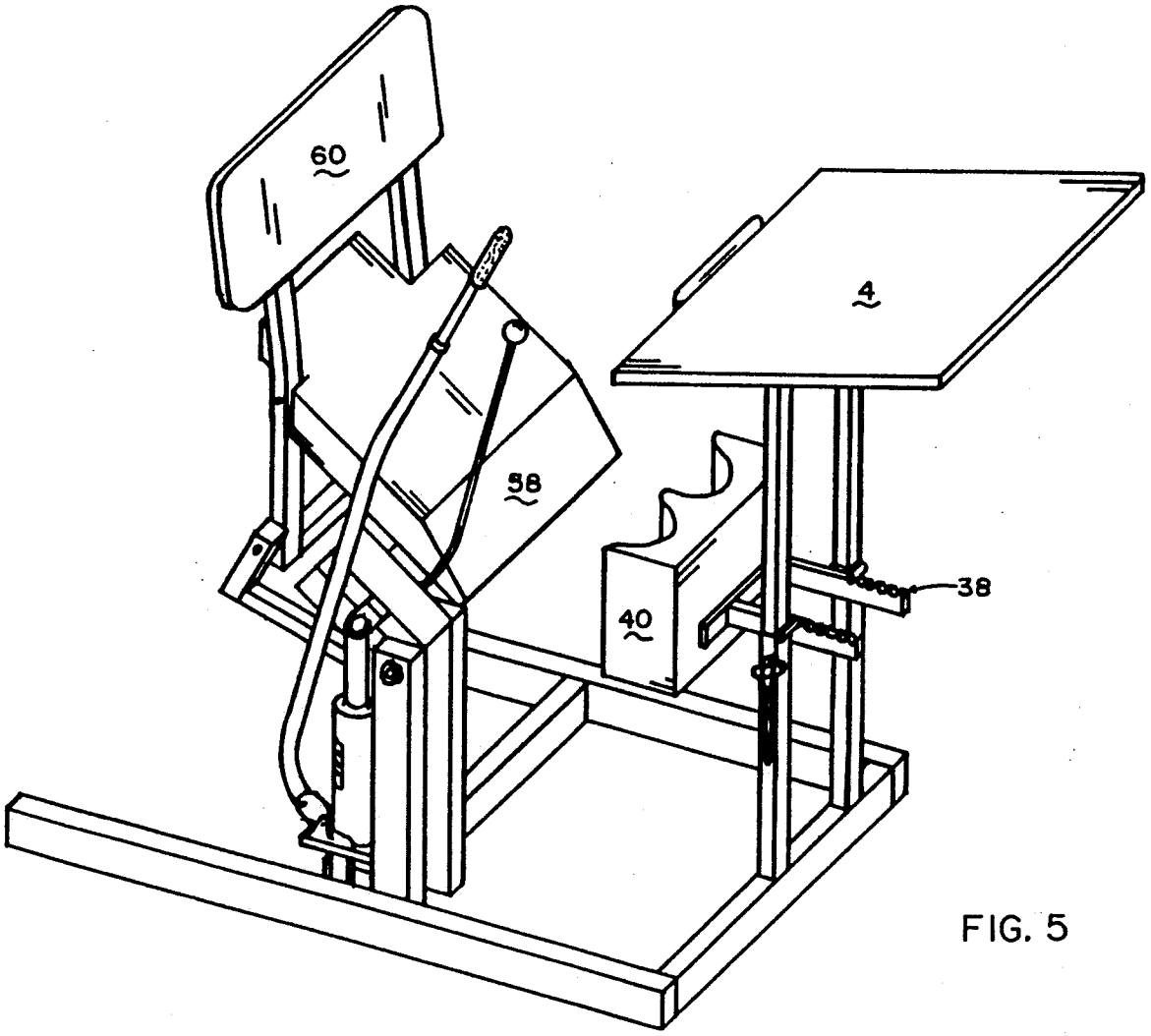
FIG. 5 shows an isometric view of the invention with the seat partially opened.
Figure 6:
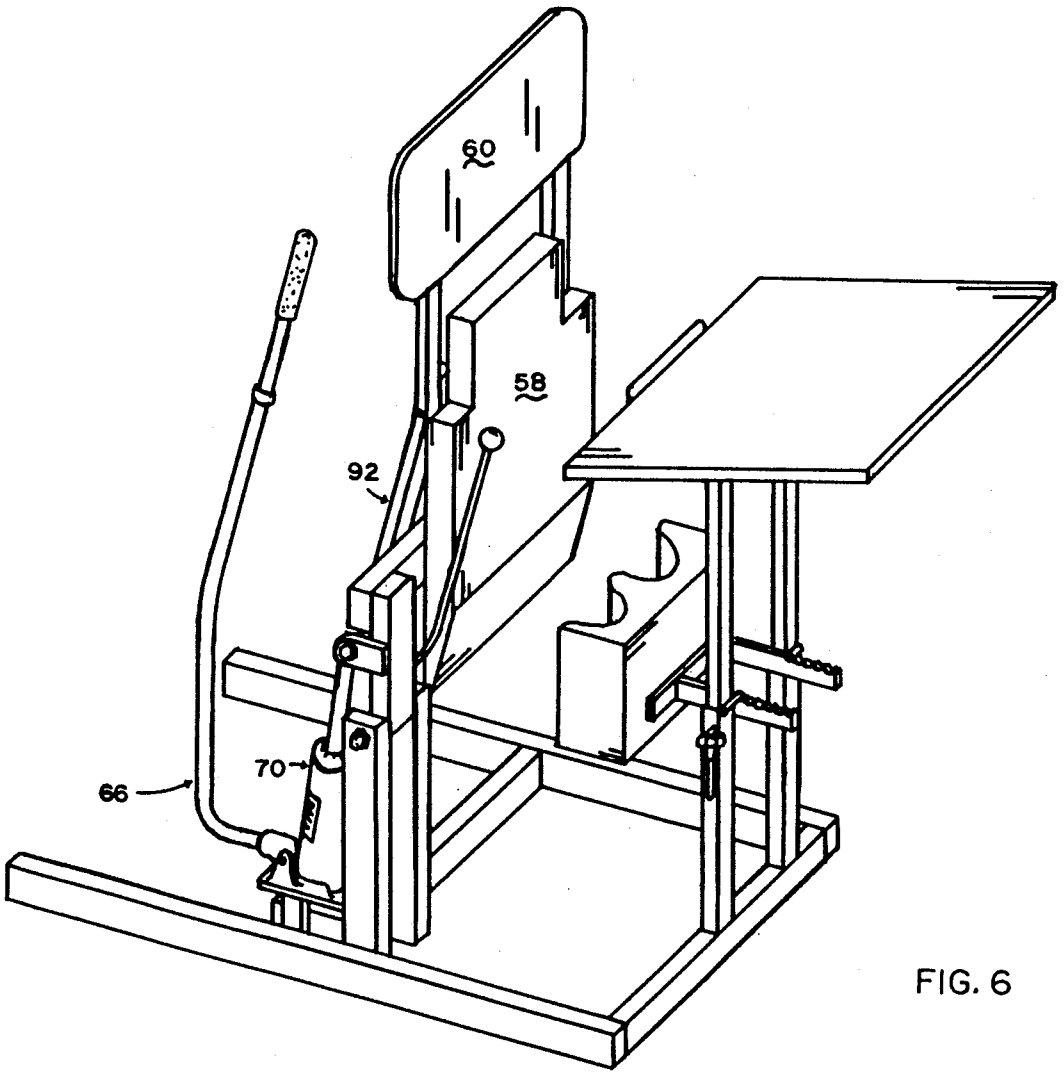
FIG. 6 shows an isometric view of the invention with the seat platform fully opened.

With the foregoing seat support framework 6 in mind and directing attention to FIGS. 5 and 6, upon operating the hand pump lever 63, the rising action of the piston 64 induces a lifting and rotation of the arm 68 which, in turn, induces a corresponding lifting and rotation of the seat cushion 58, the follower arm 92 and the backrest support framework 86.. The relative rotation of the seat support framework 6 to the backrest support portion 86 is controlled via the follower arm 92. The relative affects of the pumping action to the pivotally mounted seat and backrest support frameworks can particularly be seen in FIG. 6 and wherein the fully extended condition is depicted. In this position, the user's back is fully supported.

Referring next to FIG. 7, an alternative construction 98 of the present invention is shown in partial cutaway. While generally performing the same functions as the assembly 2 of FIGS. 1 through 6, the assembly of FIG. 7 has been modified most notably in the areas of the tabletop 100 and the knee/calf support assembly 52 and to further include an upper body exerciser assembly 102 which is securable to the ends of the cross member 87. Otherwise, the assembly 98 is substantially the same.

Directing attention to the areas of the modifications, it is to be noted that a single forward upright 104 extends from the base support cross member 14. An extension member 106 is adjustably mounted thereto via a number of aligning apertures and rigidly secured to a pair of longitudinal tabletop support frame members 108. The tabletop is secured to the members 108 and a leaning support 110 is provided along the aft edge of the tabletop 100. While the leaning support 110 and tabletop 100 are rigidly mounted to one another, it is to be appreciated they might be secured in hinged relation to each other, upon employing appropriate link arms in the fashion of the earlier-described arms 32. A cushion might also be mounted to the leaning support 110. The support 110 might also be mounted to the extension member 106 in the fashion of the assembly of FIG. 11.

Relative to the upper body exerciser 102, it generally comprises a pair of vertical upright extensions 112 which support an upper cross member 114. Supported from pairs of pulleys 116 secured to the ends of the cross member 114 and to welded tail members 120 are lengths of cable 122. Secured to one end of each cable 122 are handle members 124 and secured to the opposite ends are individual weight support members 126. Stacked annular weights 128 are mountable on each weight support member 126. Thus, a user when seated or when standing may appropriately exercise the shoulders and upper body by pushing on the handle members 124.

Figure 8:
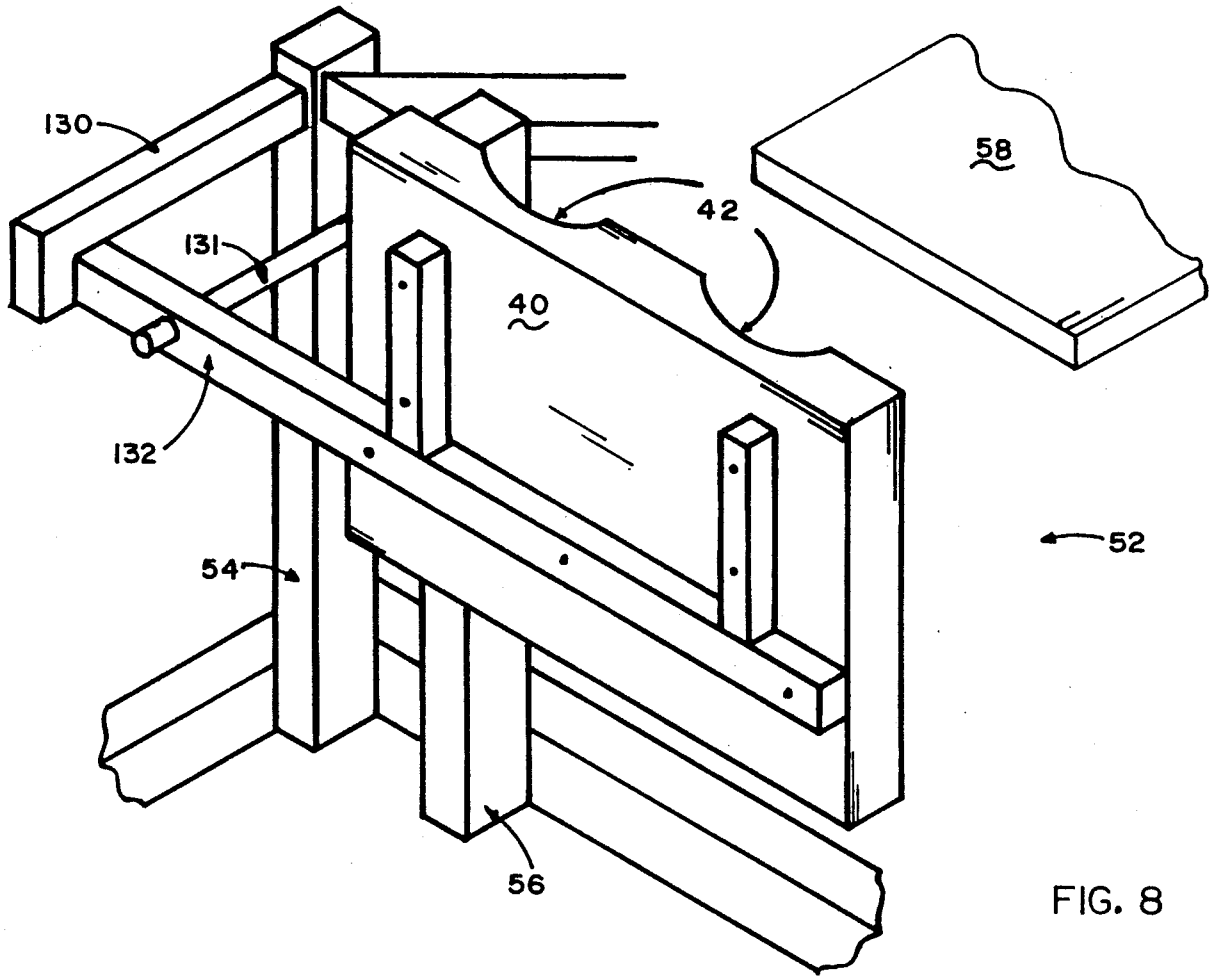
FIG. 8 shows a detailed isometric view of the pivotal knee support in its lowered position.
Figure 9:
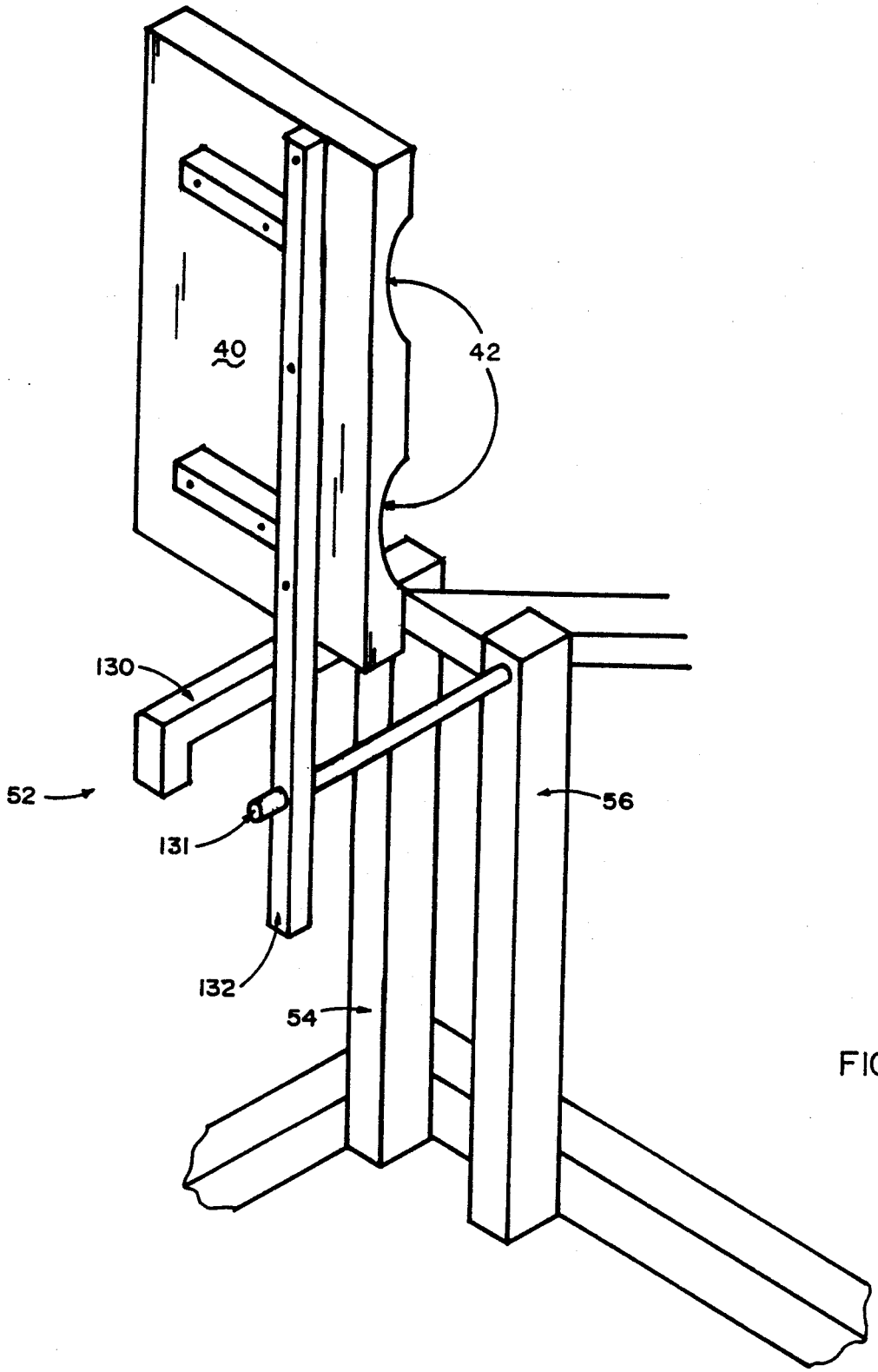
FIG. 9 shows a detailed isometric view of the pivotal knee support in its raised position.

Otherwise, directing additional attention to FIGS. 8 and 9, the knee/calf support assembly 52 is shown in detail relative to its lowered and raised positions. In contrast to the passive linearly adjusted assembly 36, the assembly 52 is pivotally supported from a length adjustable pivot member 131 that extends from the pump support uprights 56. That is, a framework 132 which supports the cushioned support 40 is pivotally mounted to rotate about the member 131 in a vertical plane parallel to the uprights 54, 56, and the user's calves. Upon being seated, the channels 42 of the cushion 40 are rotated, as opposed to being extended into engagement with the user's calves, but otherwise during seating, the assembly 52 is raised and rotated to the pump side of the assembly.

The relative separation of the knee support cushion 40 from the forward edge of the seat cushion 58 is determined via the exposure length of the pivot 131. A threaded end portion (not shown) of the member 131 and nuts (not shown) establish the members length relative to the upright 56.

The rotation of the cushion 40 is limited by an L-shaped frame member that projects from the upright 54. When fully lowered, the leftmost end of the framework 132 mounts beneath the member 130. The outer end of the member 130, otherwise, prevents the framework from disengaging from the pivot 131. In passing it is to be appreciated that the support assembly 52 might be spring biased via springs and stops concentrically positioned on the pivot pin 131 to provide a longitudinal bias of the support assembly 130 toward the seat 58. Upon adjusting the exposed length of the pivot pin 131, the tension on the spring 132 may be increased or decreased as desired.

Figure 10:
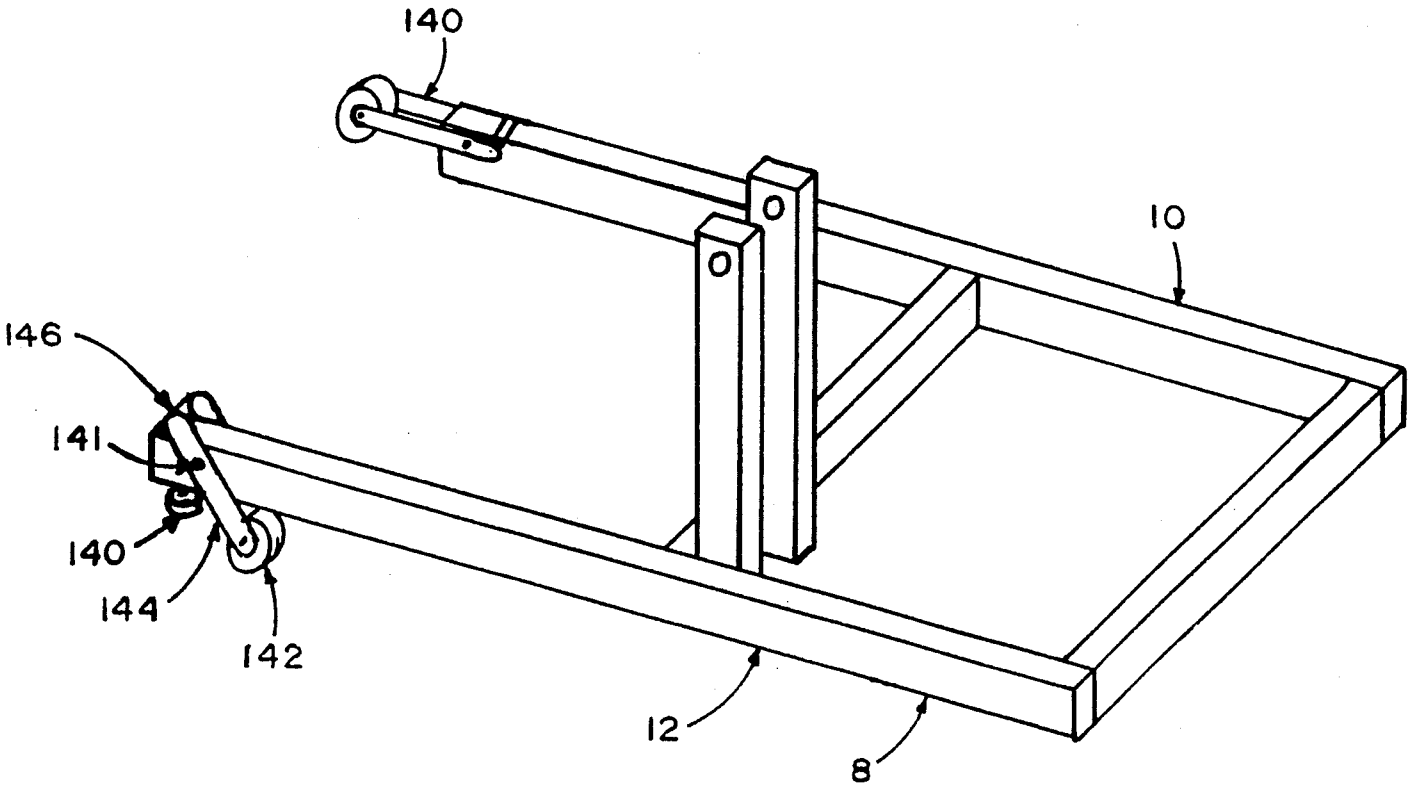
FIG. 10 shows a caster assembly in alternative mounting positions relative to the base support framework.

With attention lastly directed to FIG. 10, a view is shown of the alternative mounting positions of adjustable caster assemblies 140 which may be mounted to the base support framework 8. Each assembly 140 is rotatable about a pivot pin 141 secured to one of the longitudinal frame members 10, 12 to engage/disengage a wheel 142 from contact with the ground, upon rotating the pivotally mounted support links 144 via an end handle member 146. Upon appropriately positioning such the caster assemblies 140, the assemblies 2 or 98 may be maneuvered to desired locations.

While the present invention has been described with respect to its presently preferred construction and a related alternative embodiment, it is to be appreciated that still other constructions may suggest themselves of skill in the art upon exposure thereto. Accordingly, it is contemplated that the foregoing description and following claims should be interpreted to include all those functionally equivalent embodiments within the spirit and scope of the following claims.

What is claimed is:

1. Seating support apparatus comprising:

a) a support framework having a fore and an aft end and including a plurality of frame members coupled to one another to form a base portion, an upright extensible means secured to said fore end and first and second stationary uprights mounted adjacent one another along one side of the framework;

b) a tabletop secured to said extensible means;

c) a cushion projecting from said extensible means and coupled to at least one arm having a plurality of notches in one surface and wherein said arm is mounted relative to a pair of pins secured to said extensible means such that a first one of said pins pivotally supports said arm relative a second pin which is selectively mountable within one of said plurality of notches upon rotating and extending said arm relative to said first pin and whereby the knees and calves of a user are selectively supported via said cushion;

d) hydraulic pump means secured to said framework adjacent said first and second uprights including a hand pump lever and pressure release means for extending and retracting a piston;

e) a support framework including a first member pivotally mounted between said first and second uprights, means for pivotally coupling said piston to said first member, a seat portion, a backrest portion, a follower member pivotally secured at one end to one of said first and second uprights and at an opposite end to said backrest portion, and wherein said seat portion is rigidly secured at a fore end to said first member and pivotally secured at an aft end to said backrest portion such that movement of the piston rotates said first member and seat portion with the backrest portion rotating in unison via said follower member between a first planar orientation wherein said seat and backrest portions are transverse to each other and a second planar orientation wherein said seat and backrest portions are parallel to one another.

2. Apparatus as set forth in claim 1 including means coupled to said tabletop for varying the tilt angle of said tabletop.

3. Apparatus as set forth in claim 2 including means transversely projecting from said upright extensible means and having a second cushion for selectively positioning said second cushion to support the mid-section of a user when standing.

4. Apparatus as set forth in claim 1 wherein said first cushion provides a support surface containing first and second recessed vertical channelways whereat the knees/calves of a user are restrained.

5. Apparatus as set forth in claim 1 including first and second armrest members mounted to said backrest portion and means for pivotally coupling at least one of said armrest members to said backrest portion.

6. Apparatus as set forth in claim 1 wherein said hand pump lever includes a hand hold portion mounted in slidably extensible relation to a portion secured to said pump means.

7. Seating support apparatus comprising:

a) a support framework comprised of a plurality of frame members coupled to one another to form a base portion and having fore and aft ends and including first and second columns, each column being comprised of a pair of upright frame members mounted in extensible relation to each other and the fore end, and third and fourth upright members mounted adjacent one another along one side of said framework;

b) a tabletop mounted to said first and second columns;

c) means transversely projecting from said first and second columns including a cushion for selectively extending said cushion to restrain the knees/calves of a user;

d) means secured to said framework adjacent said third and fourth upright members including a hand pump lever and a hand release lever for raising and lowering a piston;

e) support means including a seat portion, a backrest portion, means for pivotally coupling said piston to said seat, a follower member pivotally secured at one end to one of said third and fourth uprights and at an opposite end to said backrest portion, and wherein said seat portion is pivotally secured at a fore end to one of said third and fourth upright members and pivotally secured at an aft end to said backrest portion such that movement of the piston rotates said seat portion with the backrest portion rotating in unison via said follower member between a first orientation wherein said seat and backrest portions are transverse to each other and a second orientation wherein said seat and backrest portions are parallel to one another.

8. Apparatus as set forth in claim 7 wherein said knee/calf restraint means comprises at least one arm having a plurality of notches in one surface and wherein said arm is mounted relative to at least one pair of pins secured to one of said first and second columns such that a first one of said pins pivotally supports said arm relative to a second pin which is selectively mountable within one of said plurality of notches upon rotating and extending or retracting said arm relative to the first pin.

9. Apparatus as set forth in claim 7 including second means transversely projecting in relation to said first and second columns for selectively extending a second cushion to support the midsection of the user when standing.

10. Apparatus as set forth in claim 7 wherein said backrest portion includes pulley means having as least one cable including a handle member at one end and an exercise weight support member at an opposite end.

* * * * *